US008079807B2

(12) United States Patent
Shapiro et al.

(10) Patent No.: US 8,079,807 B2
(45) Date of Patent: Dec. 20, 2011

(54) MOUNTING APPARATUS FOR LOW-DUCTILITY TURBINE SHROUD

(75) Inventors: Jason David Shapiro, Methuen, MA (US); Roger Lee Doughty, Pleasant Plain, OH (US); Aaron Dziech, Cincinnati, OH (US); Victor Correia, Milton Mills, NH (US); Elias Lampes, Lynnfield, MA (US); Robert Carella, Beverly, MA (US); Brian Corsetti, Stoneham, MA (US)

(73) Assignee: General Electric Company, Schenectady, NY (US)

( * ) Notice: Subject to any disclaimer, the term of this patent is extended or adjusted under 35 U.S.C. 154(b) by 18 days.

(21) Appl. No.: 12/696,566

(22) Filed: Jan. 29, 2010

(65) Prior Publication Data

US 2011/0189009 A1 Aug. 4, 2011

(51) Int. Cl.
*F01D 11/08* (2006.01)
*F04D 29/08* (2006.01)

(52) U.S. Cl. ..... 415/173.1; 415/174.4; 416/191

(58) Field of Classification Search ..... 415/170.1, 415/173.6, 135, 174.4, 173.1; 416/191
See application file for complete search history.

(56) References Cited

U.S. PATENT DOCUMENTS

| | | | | |
|---|---|---|---|---|
| 4,411,594 | A | 10/1983 | Pellow et al. | |
| 5,074,748 | A | 12/1991 | Hagle | |
| 5,154,577 | A | 10/1992 | Kellock et al. | |
| 5,181,827 | A | 1/1993 | Pellow et al. | |
| 5,188,507 | A | 2/1993 | Sweeney | |
| 5,655,876 | A | 8/1997 | Rock et al. | |
| 5,927,942 | A | 7/1999 | Stahl et al. | |
| 6,290,459 | B1 | 9/2001 | Correia | |
| 6,340,285 | B1 | 1/2002 | Gonyou et al. | |
| 6,413,042 | B2 | 7/2002 | Correia | |
| 6,503,051 | B2 | 1/2003 | Predmore | |
| 6,733,233 | B2 * | 5/2004 | Jasklowski et al. | 415/135 |
| 2008/0206046 | A1 | 8/2008 | Razzell et al. | |
| 2010/0102144 | A1 | 4/2010 | Conete | |

FOREIGN PATENT DOCUMENTS

| | | |
|---|---|---|
| FR | 2580033 | 10/1986 |

OTHER PUBLICATIONS

Marusko et al., U.S. Appl. No. 12/790,209, filed May 28, 2010.
Albers et al., U.S. Appl. No. 12/821,599, filed Jun. 23, 2010.
Dziech et al., U.S. Appl. No. 12/895,007, filed Sep. 30, 2010.
Albers et al., U.S. Appl. No. 12/915,424, filed Oct. 29, 2010.
Albers et al., U.S. Appl. No. 12/982,082, filed Dec. 30, 2010.
Albers et al., U.S. Appl. No. 12/982,105, filed Dec. 12, 2010.

* cited by examiner

*Primary Examiner* — Edward Look
*Assistant Examiner* — Dwayne J White
(74) *Attorney, Agent, or Firm* — David J. Clement; Trego, Hines & Ladenheim, PLLC

(57) ABSTRACT

A turbine shroud apparatus is provided for a gas turbine engine having a central axis. The apparatus includes: (a) an annular support member; (b) a turbine shroud disposed in the support member, the shroud being a continuous ring comprising a low-ductility material and having opposed flowpath and back surfaces, and opposed forward and aft ends; and (c) a spring mounted between the support member and the shroud and arranged to resiliently urge the shroud to a concentric position within the structural member.

16 Claims, 7 Drawing Sheets

MOUNTING APPARATUS FOR LOW-DUCTILITY TURBINE SHROUD

BACKGROUND OF THE INVENTION

This invention relates generally to gas turbine engines, and more particularly to apparatus and methods for mounting shrouds made of a low-ductility material in the turbine sections of such engines.

A typical gas turbine engine includes a turbomachinery core having a high pressure compressor, a combustor, and a high pressure turbine in serial flow relationship. The core is operable in a known manner to generate a primary gas flow. The high pressure turbine (also referred to as a gas generator turbine) includes one or more rotors which extract energy from the primary gas flow. Each rotor comprises an annular array of blades or buckets carried by a rotating disk. The flowpath through the rotor is defined in part by a shroud, which is a stationary structure which circumscribes the tips of the blades or buckets. These components operate in an extremely high temperature environment, and must be cooled by air flow to ensure adequate service life. Typically, the air used for cooling is extracted (bled) from the compressor. Bleed air usage negatively impacts specific fuel consumption ("SFC") and is should generally be minimized.

It has been proposed to replace metallic shroud structures with materials having better high-temperature capabilities, such as ceramic matrix composites (CMCs). These materials have unique mechanical properties that must be considered during design and application of an article such as a shroud segment. For example, CMC materials have relatively low tensile ductility or low strain to failure when compared with metallic materials. Also, CMCs have a coefficient of thermal expansion (CTE) in the range of about 1.5-5 microinch/inch/degree F., significantly different from commercial metal alloys used as supports for metallic shrouds. Such metal alloys typically have a CTE in the range of about 7-10 microinch/inch/degree F. Therefore, if a CMC type of shroud is restrained by a metallic support during operation, forces can be developed in the CMC type shroud sufficient to cause failure.

Given the difference in thermal expansion coefficients between the CMC shroud and surrounding metal structures it is not possible to hold the shroud to the engine using mechanical fasteners such as bolts or C-clips. Additionally, any type of rigid mechanical connection would induce very high stresses into the shroud and impact turbine clearance control.

BRIEF SUMMARY OF THE INVENTION

These and other shortcomings of the prior art are addressed by the present invention, which provides a turbine shroud mounting assembly that supports a turbine shroud while permitting thermal growth.

According to one aspect of the invention, a turbine shroud apparatus is provided for a gas turbine engine having a central axis. The apparatus includes: (a) an annular support member; (b) a turbine shroud disposed in the support member, the shroud being a continuous ring comprising a low-ductility material and having opposed flowpath and back surfaces, and opposed forward and aft ends; and (c) a spring mounted between the support member and the shroud and arranged to resiliently urge the shroud to a concentric position within the structural member.

According to another aspect of the invention, a turbine shroud apparatus for a gas turbine engine having a central axis is provided, including: (a) an annular support member including a plurality of hanger tabs extending radially inward from an inner surface thereof; (b) a mounting block extending radially inward from the inner surface of the support member near each hanger tab; (c) a turbine shroud disposed in the support member, the turbine shroud being a continuous ring comprising a low-ductility material and having opposed flowpath and back surfaces, and opposed forward and aft ends, the back surface having a plurality of longitudinally-extending ribs extending radially therefrom, each rib disposed between one of the hanger tabs and the neighboring mounting block; and (c) a spring disposed between each of the mounting blocks and the associated rib, the springs urging each of the ribs in a tangential direction relative to the central axis, so as to bear against its respective hanger tab.

According to another aspect of the invention, a turbine shroud apparatus for a gas turbine engine having a central axis is provided, including: (a) an annular support member; (b) a turbine shroud disposed in the support member, the turbine shroud being a continuous ring comprising a low-ductility material and having opposed flowpath and back surfaces, and opposed forward and aft ends, the back surface having a plurality of longitudinally-extending ribs extending radially therefrom; and (c) a plurality of elongated springs disposed between the support member and the shroud, each spring being oriented in a generally tangential direction relative to the central axis and having a first end secured to the support member and a second end which engages ones of the ribs of the shroud, wherein the springs are collectively arranged to resiliently urge the shroud to a concentric position within the structural member.

BRIEF DESCRIPTION OF THE DRAWINGS

The invention may be best understood by reference to the following description taken in conjunction with the accompanying drawing figures in which.

DETAILED DESCRIPTION OF THE INVENTION

Figure 1:
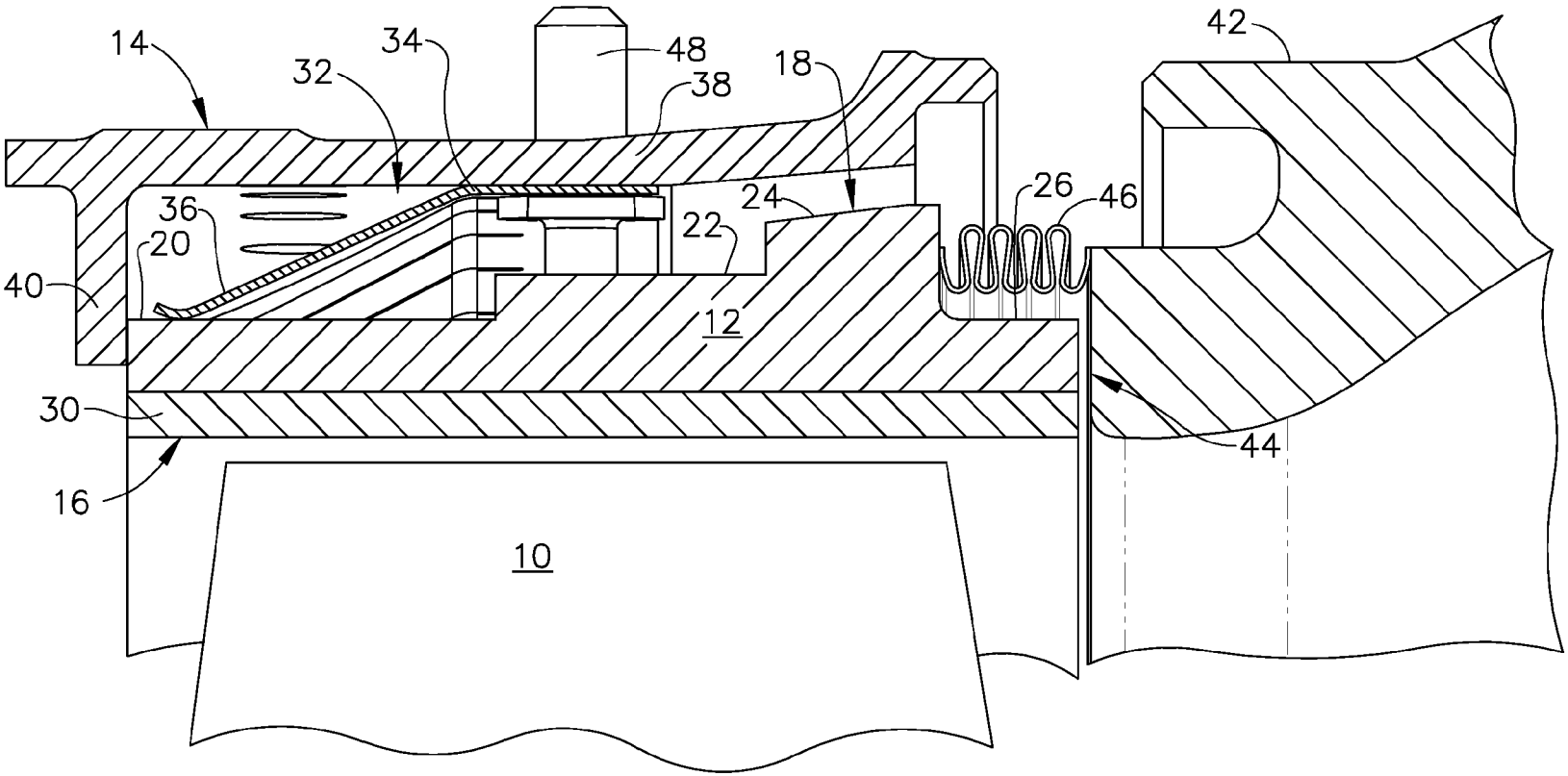
FIG. 1 a schematic cross-sectional view of a turbine shroud and mounting apparatus constructed in accordance with an aspect of the present invention.
Figure 2:
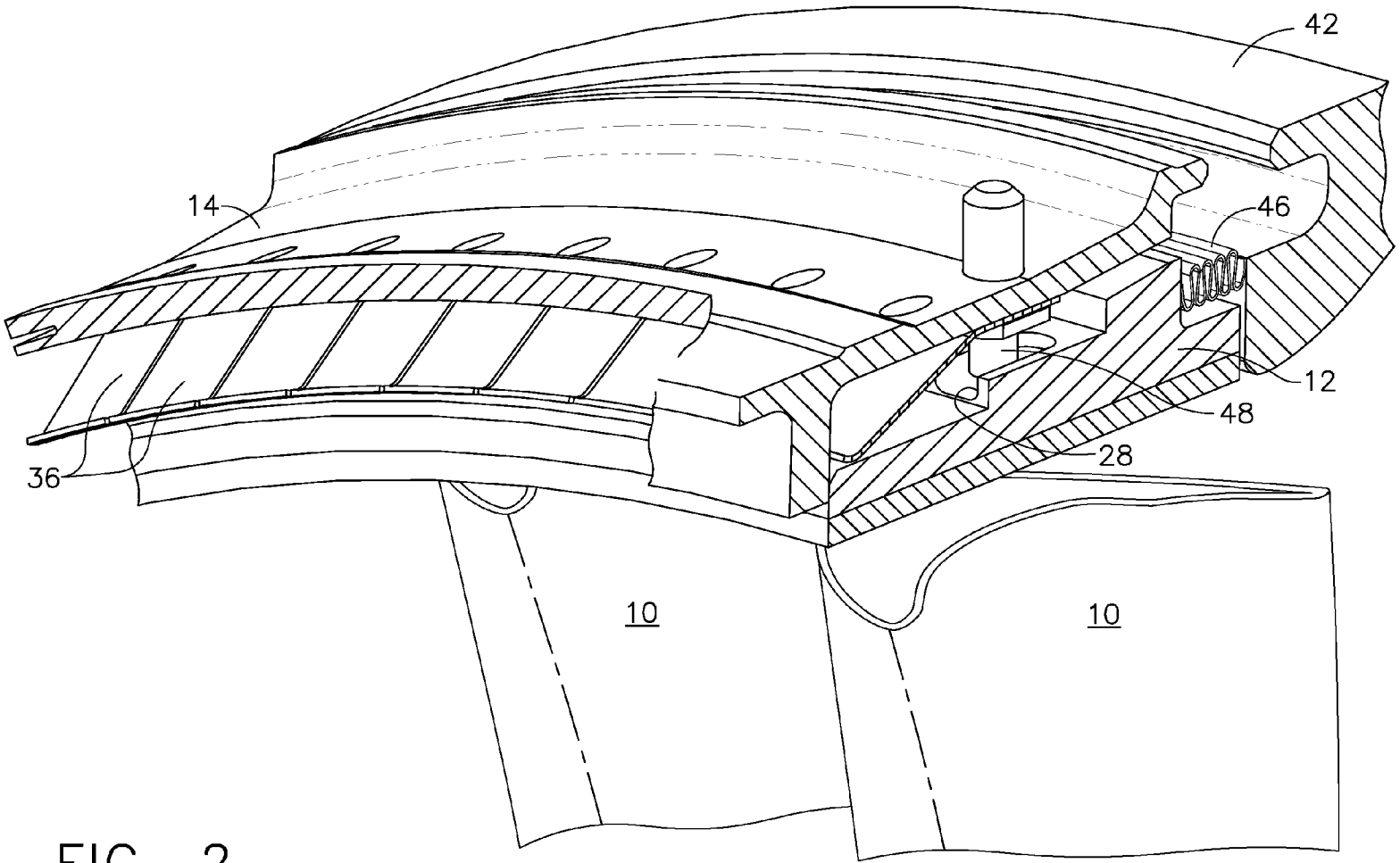
FIG. 2 is a partial perspective view of the turbine shroud and mounting apparatus shown in FIG. 1.

Referring to the drawings wherein identical reference numerals denote the same elements throughout the various views, FIGS. 1 and 2 depict a portion of a high pressure turbine in gas turbine engine. A row of airfoil-shaped turbine blades 10 are carried by a rotating disk (not shown) in a conventional manner. It will be understood that the disk rotates about a longitudinal central axis of the engine. The blades 10 are surrounded by an annular turbine shroud 12 which is supported within the central aperture of an encircling support member. In the illustrated example the support member is an annular "shroud hanger" 14 which is itself supported by a stationary casing (not shown). The shroud hanger 14 may be continuous or segmented. For the purpose of the invention it is not critical whether or not a separate shroud hanger is present, as the shroud 12 may be mounted directly to a casing.

The shroud 12 is a one-piece 360° component. It is generally cylindrical and has a radially inner flowpath surface 16 and an a radially outer back surface 18. The cross-sectional shape of the shroud 12 includes, from front to rear, a first generally cylindrical portion 20, a raised step 22, a radially-outwardly-extending flange 24, and a second generally cylindrical portion 26. As best seen in FIG. 2, one or more longitudinal grooves 28 are formed in the step 22.

The shroud 12 is constructed from a ceramic matrix composite (CMC) material of a known type. Generally, commercially available CMC materials include a ceramic type fiber for example SiC, forms of which are coated with a compliant material such as Boron Nitride (BN). The fibers are carried in a ceramic type matrix, one form of which is SiC. Typically, CMC type materials have a room temperature tensile ductility of no greater than about 1%, herein used to define and mean a low tensile ductility material. Generally CMC type materials have a room temperature tensile ductility in the range of about 0.4 to about 0.7%. This is compared with metals having a room temperature tensile ductility of at least about 5%, for example in the range of about 5 to about 15%. The shroud 12 could also be constructed from other low-ductility, high-temperature-capable materials.

The flowpath surface 16 of the shroud 12 is coated with a layer of an abradable material 30 of a known type suitable for use with CMC materials. This layer is sometimes referred to as a "rub coat". In the illustrated example, the abradable material 30 is about 0.762 mm (0.030 in.) thick.

A spring 32 is disposed between the shroud hanger 14 and the shroud 12 and serves to provide a radial centering force on the shroud 12. In the illustrated example, the spring 32 is a continuous ring with a cylindrical portion 34 and an array of longitudinally-extending spring fingers 36 that press against the first generally cylindrical portion 20 of the shroud 12, in an inboard direction.

The shroud hanger 14 is generally "L" shaped in cross-section and includes an axially-extending body 38 and a radially-inwardly-extending flange 40. It may be a continuous ring or segmented. The flange 40 bears against the forward edge of the shroud 12 and restrains it from moving axially forward.

A static element 42 is disposed just aft of the shroud 12. In the illustrated example, the static element 42 is a portion of a second-stage turbine nozzle. The primary function of the static element 42 is not critical to the present invention, which may also be implemented in a single-stage turbine. In any event, the static element 42 includes an axially-forward facing front face 44. A spring element 46 is disposed between the front face 44 and the shroud 12 and serves to elastically load the shroud 12 against the flange 40 of the shroud hanger 14. In this particular example, the spring element 46 is an annular "W" seal with a convoluted cross-section. The shroud 12 is free to move against the spring element 46 as it expands and contracts without breakage.

One or more anti-rotation pins 48 are carried by the shroud hanger 14. Three or more equally-spaced anti-rotation pins 48 provide complete centering of the shroud 12. The outer end of each anti-rotation pin 48 is securely retained in the shroud hanger 14, for example by interference fit, mechanical fit, or bonding (e.g. welding or brazing). The anti-rotation pins 48 extend radially inward and are received in the grooves 28. The anti-rotation pins 48 and the grooves 28 are sized to provide a tight fit in a tangential direction in order to provide effective anti-rotation. As used herein the term "tight fit" means that the shroud 12 has the minimum practical clearance in the tangential direction, while also being free to move radially relative to the anti-rotation pin 48. In the radial direction, the gap between the groove 28 and the end of the anti-rotation pin 48 is sized so that radially outward movement of the shroud 12 will be stopped by the anti-rotation pin 48 before the turbine blade 10 can penetrate the abradable material 30 and contact the CMC portion of the shroud 12. In other words, the range of motion permitted by the anti-rotation pin 48 is less than the thickness of the abradable material 30. This configuration prevents severe blade tip damage.

Figure 3:
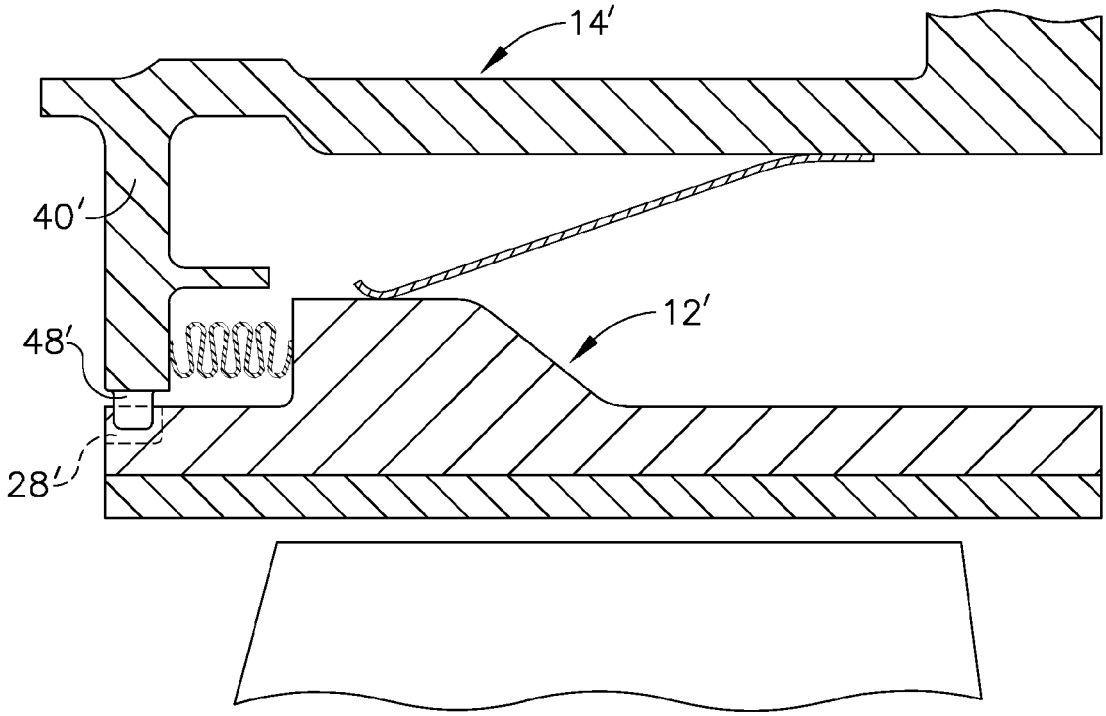
FIG. 3 is a cross-sectional view of an alternative support member.

As an alternative to the separate anti-rotation pins 48, anti-rotation may be provided as an integral feature of the shroud hanger 14. For example, FIG. 3 illustrates a shroud hanger 14' with an integral pin 48' extending from a radially inner end of a flange 40'. The pin 48' is received in a blind slot 28' formed at the forward end of the shroud 12'.

Figure 4:
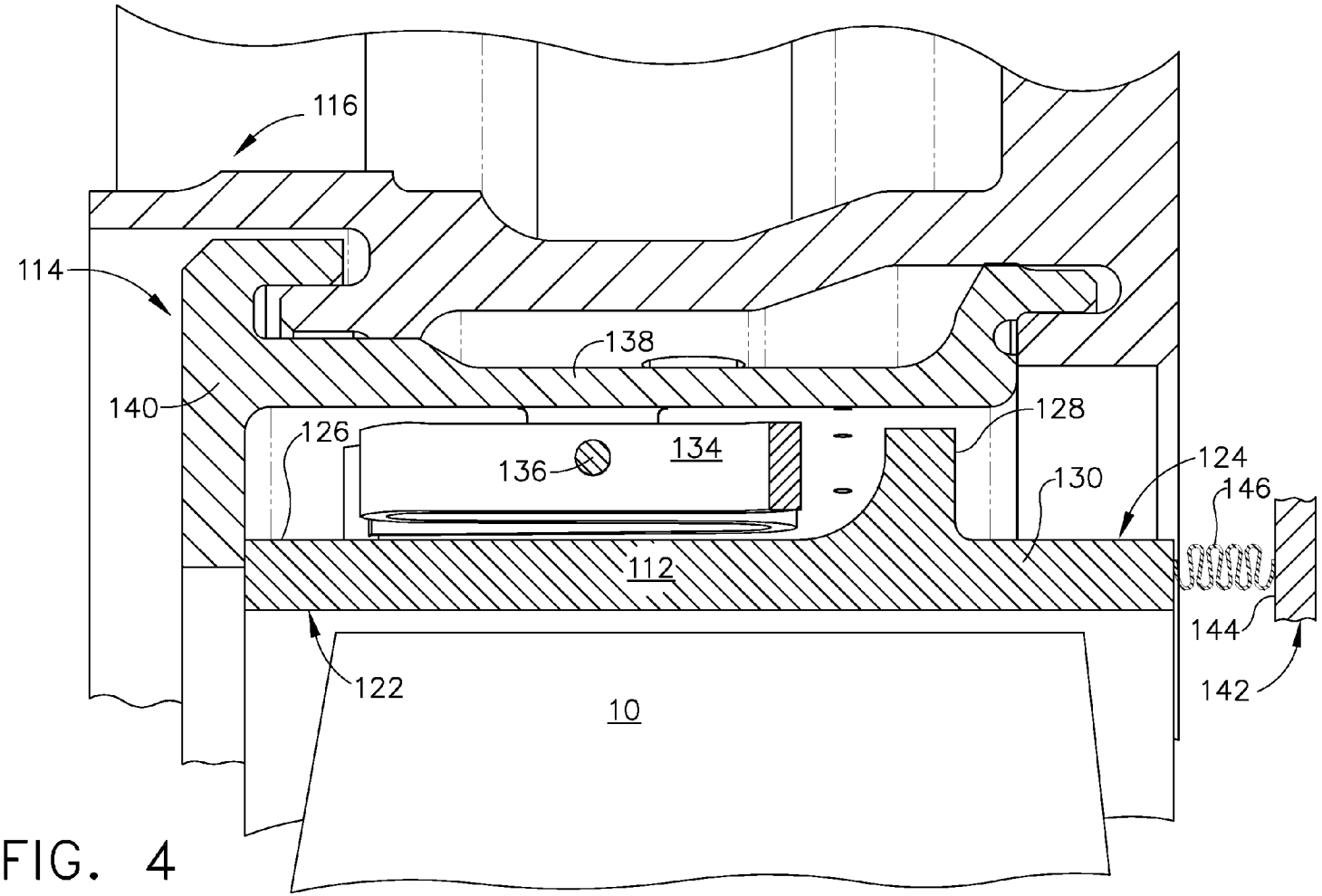
FIG. 4 is a schematic cross-sectional view of a turbine shroud and mounting apparatus constructed in accordance with an alternate aspect of the present invention.
Figure 5:
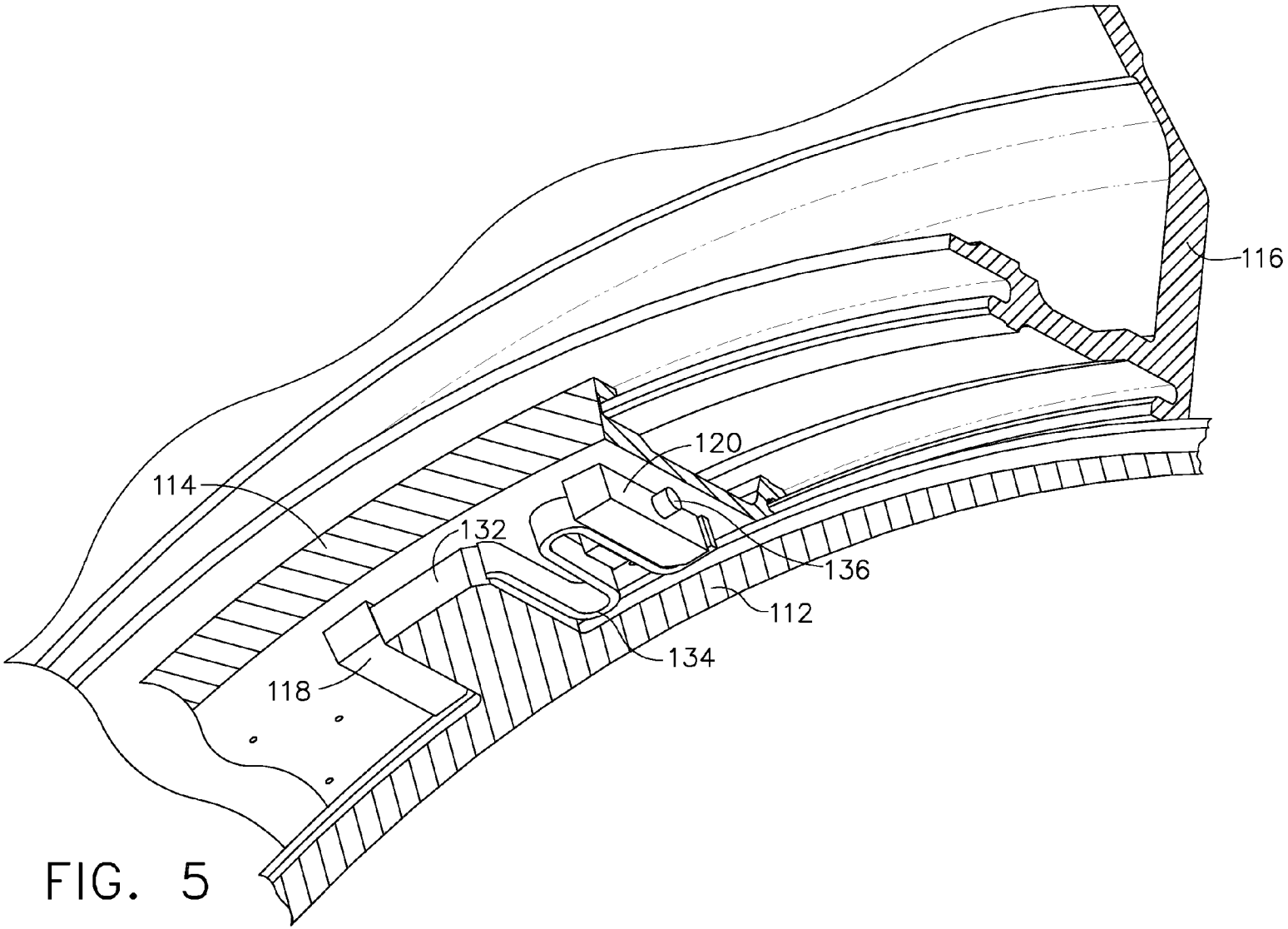
FIG. 5 is a partial perspective view of the turbine shroud and mounting apparatus shown in FIG. 4.

FIGS. 4 and 5 depict an alternative shroud 112 supported by a support member. In the illustrated example the support member is an annular "shroud hanger" 114 which is itself supported by a stationary casing 116. For the purpose of the invention it is not critical whether or not a separate shroud hanger 114 is present, as the shroud 114 may be mounted directly to the casing 116. The shroud hanger 114 includes a plurality of longitudinal hanger tabs 118 extending radially inward, as well as a plurality of spring mounting blocks 120 extending radially inward. Each mounting block 120 is spaced a short distance from one of the hanger tabs 118.

The shroud 112 is a one-piece 360° component constructed from a ceramic matrix composite (CMC) material as described above, and may include an abradable material or "rub coat" as described above (not shown). The shroud 112 is generally cylindrical and has a radially inner flowpath surface 122 and an a radially outer back surface 124. The cross-sectional shape bounded by the back surface 124 includes, from front to rear, a first generally cylindrical portion 126, a radially-outwardly-extending flange 128, and a second generally cylindrical portion 130. As best seen in FIG. 5, one or more longitudinal ribs 132 extend radially outward from the back surface 124.

A spring 134 is disposed between the rib 132 and the mounting block 120 and urges the rib 132 tangentially against the adjacent hanger tab 118, in the direction of blade rotation. It will be understood that, while the spring 134 is oriented in a tangential direction relative to the shroud 112, it will oppose radial forces acting on the shroud 112 at a location 90° from the spring 134. Three or more of these combinations of a rib 132, hanger tab 118, spring 134, and mounting block 120 are provided around the periphery of the shroud 112. In combination they serve to provide complete radial centering of the shroud 112, while allowing thermal (diametrical) growth. In the illustrated example, the spring 134 is a compression type spring with a convoluted leaf configuration. A mounting pin 136 secures one end of the spring 134 through the spring 134 and the mounting block 120.

The shroud hanger 114 is generally "L" shaped in cross-section and includes an axially-extending body 138 and a radially-inwardly-extending flange 140 (see FIG. 4). It may be a continuous ring or segmented. The flange 140 bears against the forward edge of the shroud 112 and restrains it from moving axially forward.

A static element 142 is disposed just aft of the shroud 112. In the illustrated example, the static element 142 is a portion of a second-stage turbine nozzle. The primary function of the static element 142 is not critical to the present invention, which may also be implemented in a single-stage turbine. In any event, the static element 142 includes an axially-forward facing front face 144. A spring element 146 is disposed between the front face 144 and the shroud 112 and serves to elastically load the shroud 112 against the flange 140 of the shroud hanger 114. In this particular example, the spring element 146 is an annular "W" seal with a convoluted cross-section. The shroud 112 is free to move against the spring element 146 as it expands and contracts without breakage.

Figure 6:
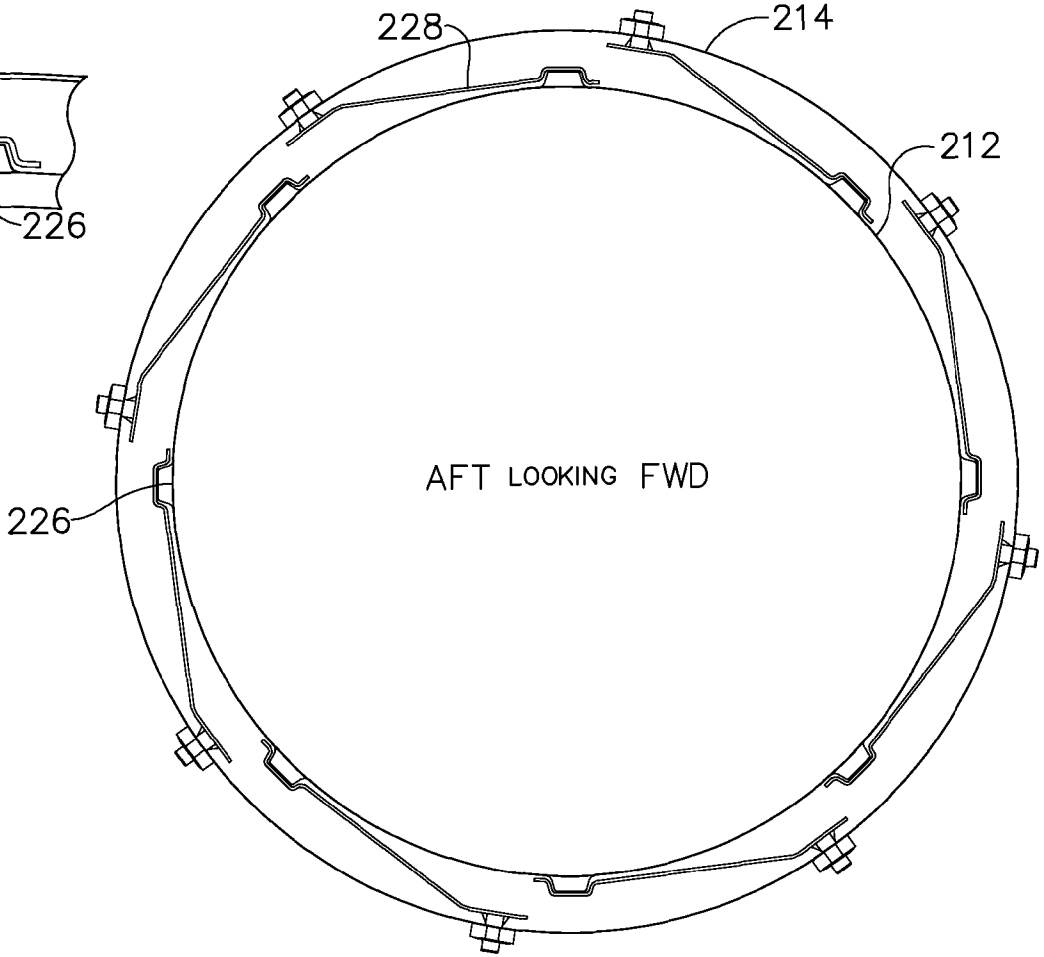
FIG. 6 is a schematic view from aft looking forward at a turbine shroud and mounting apparatus constructed in accordance with another alternate aspect of the present invention.
Figure 7:
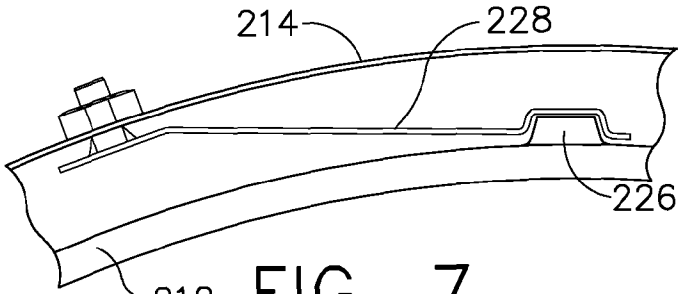
FIG. 7 is an enlarged view of a portion of FIG. 6.
Figure 8:
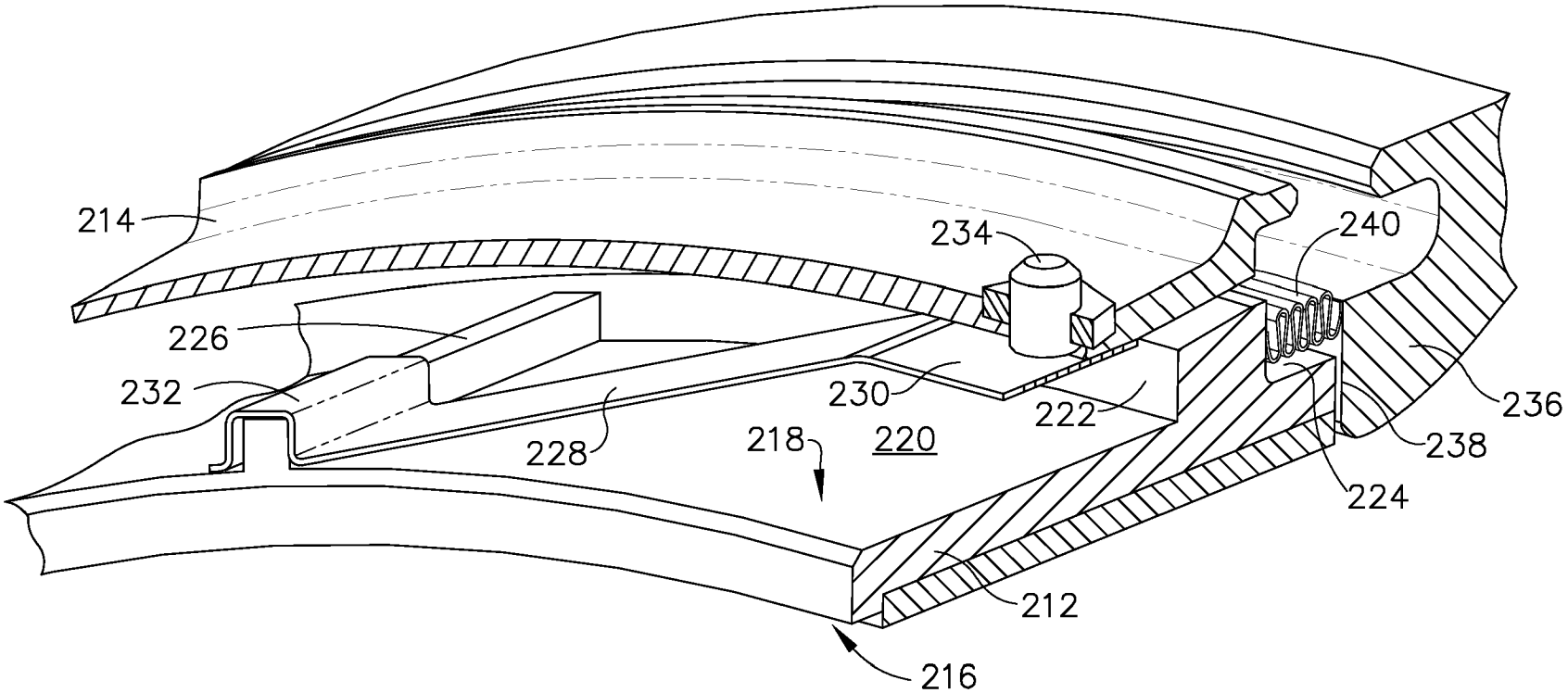
FIG. 8 is a partial perspective view of the turbine shroud and mounting apparatus shown in FIG. 6.

FIGS. 6-8 depict an alternative shroud 212 supported by a support member. In the illustrated example the support member is an annular "shroud hanger" 214 which is itself supported by a stationary casing (not shown). For the purpose of the invention it is not critical whether or not a separate shroud hanger 214 is present, as the shroud 212 may be mounted directly to the casing.

The shroud 212 is a one-piece 360° component constructed from a ceramic matrix composite (CMC) material as described above, and may include an abradable material or "rub coat" as described above (not shown). The shroud 212 is generally cylindrical and has a radially inner flowpath surface 216 and an a radially outer back surface 218. The cross-sectional shape bounded by the back surface 218 includes, from front to rear, a first generally cylindrical portion 220, a radially-outwardly-extending flange 222, and a second generally cylindrical portion 224. One or more longitudinal ribs 226 extend radially outward from the back surface 218.

A plurality of springs 228 are disposed between the shroud 212 and the shroud hanger 214. In the illustrated example, each spring 228 is a leaf-type spring oriented in a generally tangential direction and has first and second ends 230 and 232. The first end 230 is secured to the shroud hanger 214, for example using the illustrated mounting pins 234. The second end 232 is formed into a C-shape which is clipped over one of the ribs 226 of the shroud 212. The spring 228 is preloaded in bending, and urges the rib 226 radially inward. Three or more of these combinations of a rib 226 and spring 228 are provided around the periphery of the shroud 212. Each spring 228 is substantially rigid in the tangential direction, and will oppose radial forces acting on the shroud at a location 90° from the spring 228. In combination they serve to provide complete radial centering of the shroud 212, while allowing thermal (diametrical) growth.

For purposes of illustration the forward end of the shroud hanger 214 is not shown in FIG. 8. However, like the shroud hangers 14 and 114 described above, it is generally "L" shaped in cross-section and includes a radially-inwardly-extending flange which bears against the forward edge of the shroud 212 to restrain the shroud 212 from moving axially forward.

A static element 236 including an axially-forward facing front face 238 is disposed just aft of the shroud 212. A spring element 240 is disposed between the front face 238 and the shroud 212 and serves to elastically load the shroud 212 against the shroud hanger 214. The shroud 212 is free to move against the spring element 240 as it expands and contracts without breakage.

The shroud and mounting apparatus described herein has several advantages over a conventional design. The mounting apparatus supports and center the shroud within the turbine case while allowing for unrestricted radial growth. For example, a single piece, 360 degree CMC turbine shroud ring weighs less (approximately 66% reduction) and utilizes less cooling flow (approximately 50%) compared to prior art shroud designs. In addition to the performance benefit, the associated part count reduction (approximately 80%) improves maintainability of the turbine.

The foregoing has described a turbine shroud and mounting apparatus for a gas turbine engine. While specific embodiments of the present invention have been described, it will be apparent to those skilled in the art that various modifications thereto can be made without departing from the spirit and scope of the invention. Accordingly, the foregoing description of the preferred embodiment of the invention and the best mode for practicing the invention are provided for the purpose of illustration only and not for the purpose of limitation.

What is claimed is:

1. A turbine shroud apparatus for a gas turbine engine having a central axis, comprising:

(a) an annular support member;

(b) a turbine shroud disposed in the support member, the shroud being a continuous ring comprising a low-ductility material and having opposed flowpath and back surfaces, and opposed forward and aft ends;

(c) a spring mounted between the support member and the shroud and arranged to resiliently urge the shroud to a concentric position within the structural member; and (d) a spring element disposed between the turbine shroud and an axially adjacent static element which resiliently urges the shroud axially, in a direction parallel to the central axis, against a portion of the support member.

2. The apparatus of claim 1 further comprising means for preventing the shroud from rotating about the central axis relative to the support member.

3. The apparatus of claim 1 wherein the spring element is an annular seal with a convoluted cross-sectional shape.

4. The apparatus of claim 1 wherein the turbine shroud comprises a ceramic matrix composite material.

5. A turbine shroud apparatus for a gas turbine engine having a central axis, comprising:

(a) an annular support member;

(b) a turbine shroud disposed in the support member, the shroud being a continuous ring comprising a low-ductility material and having opposed flowpath and back surfaces, and opposed forward and aft ends, wherein a cross-sectional shape of the shroud includes, from front to rear, a first generally cylindrical portion, a raised step, a radially-outwardly-extending flange, and a second generally cylindrical portion; and (c) a spring mounted between the support member and the shroud and arranged to resiliently urge the shroud to a concentric position within the structural member.

6. A turbine shroud apparatus for a gas turbine engine having a central axis, comprising:

(a) an annular support member;

(b) a turbine shroud disposed in the support member, the shroud being a continuous ring comprising a low-ductility material and having opposed flowpath and back surfaces, and opposed forward and aft ends, wherein at least one longitudinal groove is formed in the back surface;

(c) a spring mounted between the support member and the shroud and arranged to resiliently urge the shroud to a concentric position within the structural member; and (d) an anti-rotation pin carried by the support member and received in the groove.

7. A turbine shroud apparatus for a gas turbine engine having a central axis, comprising:

(a) an annular support member;

(b) a turbine shroud disposed in the support member, the shroud being a continuous ring comprising a low-ductility material and having opposed flowpath and back surfaces, and opposed forward and aft ends; and (c) a spring mounted between the support member and the shroud and arranged to resiliently urge the shroud to a concentric position within the structural member, wherein the spring is a continuous ring including a cylindrical portion and an array of longitudinally-extending spring fingers that press against the shroud in an inboard direction.

8. A turbine shroud apparatus for a gas turbine engine having a central axis, comprising:

(a) an annular support member including a plurality of hanger tabs extending radially inward from an inner surface thereof;

(b) a mounting block extending radially inward from the inner surface of the support member near each hanger tab;

(c) a turbine shroud disposed in the support member, the turbine shroud being a continuous ring comprising a low-ductility material and having opposed flowpath and back surfaces, and opposed forward and aft ends, the back surface having a plurality of longitudinally-extending ribs extending radially therefrom, each rib disposed between one of the hanger tabs and the neighboring mounting block; and (c) a spring disposed between each of the mounting blocks and the associated rib, the springs urging each of the ribs in a tangential direction relative to the central axis, so as to bear against its respective hanger tab.

9. The apparatus of claim 8 wherein each of the springs is secured to the associated mounting block with a mounting pin.

10. The apparatus of claim 9 wherein a spring element disposed between the turbine shroud and an axially adjacent static element urges the shroud axially against a portion of the support member.

11. The apparatus of claim 10 wherein the spring element is an annular seal with a convoluted cross-sectional shape.

12. The apparatus of claim 8 wherein the turbine shroud comprises a ceramic matrix composite material.

13. A turbine shroud apparatus for a gas turbine engine having a central axis, comprising:

(a) an annular support member;

(b) a turbine shroud disposed in the support member, the turbine shroud being a continuous ring comprising a low-ductility material and having opposed flowpath and back surfaces, and opposed forward and aft ends, the back surface having a plurality of longitudinally-extending ribs extending radially therefrom; and (c) a plurality of elongated springs disposed between the support member and the shroud, each spring being oriented in a generally tangential direction relative to the central axis and having a first end secured to the support member and a second end which engages ones of the ribs of the shroud, wherein the springs are collectively arranged to resiliently urge the shroud to a concentric position within the structural member.

14. The apparatus of claim 13 wherein:

(a) the first end of each spring is secured to the support member by a mounting pin; and (b) the second end is formed into a C-shape which is clipped over one of the ribs of the shroud.

15. The apparatus of claim 14 wherein a spring element disposed between the turbine shroud and an axially adjacent static element resiliently urges the shroud axially against a portion of the support member.

16. The apparatus of claim 15 wherein the spring element is an annular seal with a convoluted cross-sectional shape.

* * * * *